United States Patent [19]

Bastogne

[11] 4,255,888

[45] Mar. 17, 1981

[54] INDICATOR FOR VERTICALLY SUSPENDED FILE ENVELOPES

[76] Inventor: Jacques J. Bastogne, B.P.10199, Kinshasa (Republic of Zaire), Congo

[21] Appl. No.: 952,629

[22] Filed: Oct. 19, 1978

[30] Foreign Application Priority Data

Oct. 28, 1977 [BE] Belgium ..... 860244

[51] Int. Cl.[3] ..... B42F 21/00

[52] U.S. Cl. ..... 40/359

[58] Field of Search ..... 40/359, 360, 23 A; 116/321

[56] References Cited

U.S. PATENT DOCUMENTS

| | | | |
|---|---|---|---|
| 1,008,352 | 11/1911 | Meyers | 40/360 |
| 1,473,747 | 11/1923 | Thompson | 40/359 |
| 1,697,985 | 1/1956 | Lindsey | 40/359 |
| 1,866,353 | 7/1932 | Hutchings | 40/359 |
| 2,895,448 | 7/1959 | Haines | 40/360 |
| 2,975,537 | 3/1961 | Reid et al. | 40/23 A |
| 3,269,391 | 8/1966 | Wagner | 40/359 |
| 3,329,150 | 7/1967 | Prouix | 40/23 A X |

FOREIGN PATENT DOCUMENTS

| | | | |
|---|---|---|---|
| 1497757 | 1/1966 | Fed. Rep. of Germany | 40/360 |
| 1299279 | 5/1966 | Fed. Rep. of Germany | 40/359 |

*Primary Examiner*—Gene Mancene
*Assistant Examiner*—Wenceslao J. Contreras
*Attorney, Agent, or Firm*—Zarley, McKee, Thomte, Voorhees & Sease

[57] ABSTRACT

An idicator for a vertically suspended file envelope includes an elongated body mountable on the file envelope and including a leg extending horizontally with respect to the envelope, a transparent projection extending from the free edge of the leg and over a part of the leg to define with the leg a label holder adapted to receive an elongated label therein. A plurality of markers are disposed in spaced location, each marker being movably mounted between a first position in which it covers a portion of the label and a second position in which that portion of the label is completely uncovered. The status of the file may be determined by the positions of the markers relative to the label.

6 Claims, No Drawings

FIG. 3
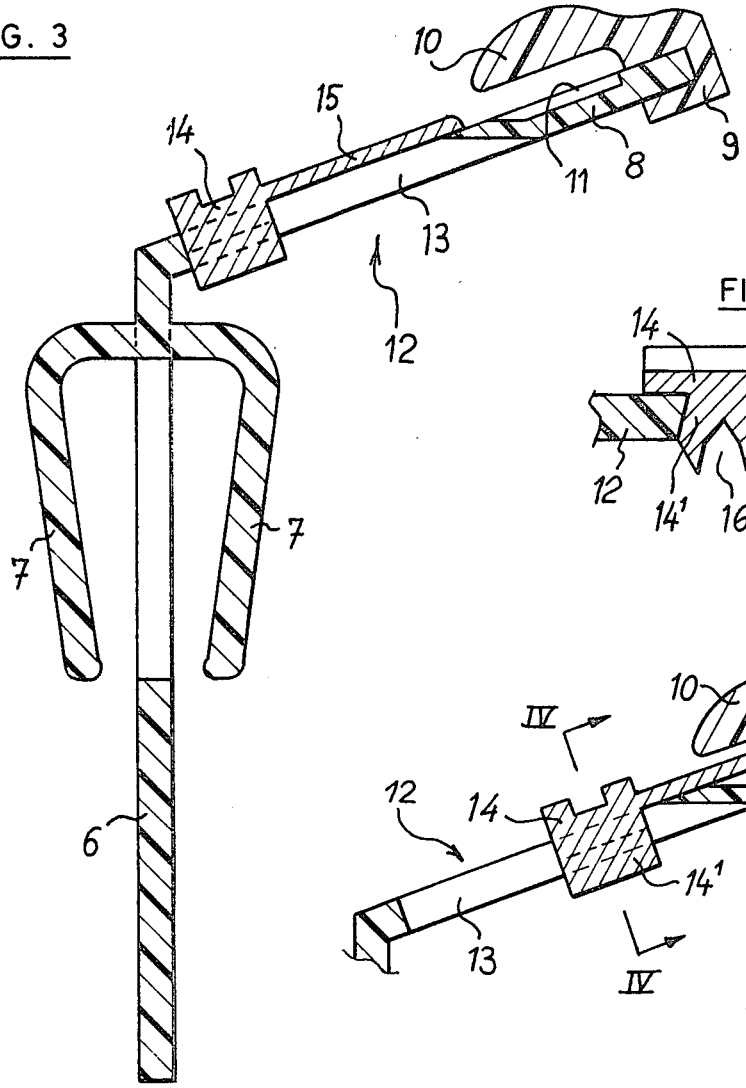
FIG. 4
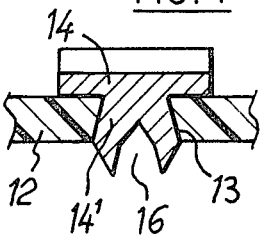
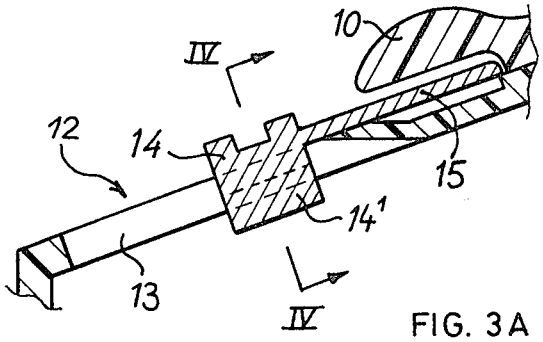
FIG. 3A
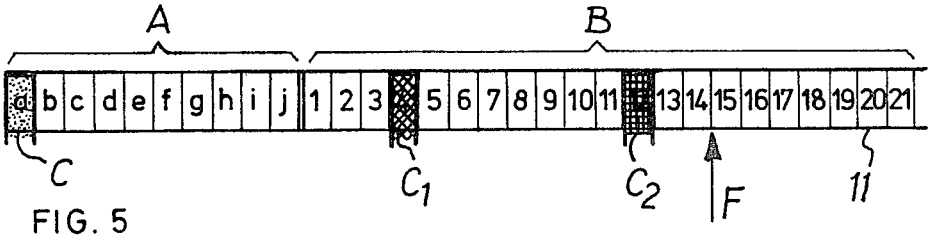
FIG. 5

INDICATOR FOR VERTICALLY SUSPENDED FILE ENVELOPES

According to the invention, there is provided an indicator mountable on a vertically suspended file envelope or the like in order to identify the file envelope, the indicator comprising an elongated body, means for mounting the body on the file envelope, the elongated body being provided with a leg extending horizontally with respect to the envelope, a transparent projection extending from the free edge of the leg and over a part of the leg to define together with the leg a label holder adapted to receive an elongated label therein with the label visible through the transparent projection. A plurality of markers or covers are disposed in spaced location, each marker being movably mounted between a first position in which it covers a portion of the label and a second position in which that portion of the label is completely uncovered. That status of the file may be determined from the positions of the markers relative to the label.

In the drawings :

FIG. 3 is a cross-sectional view of the indicator.

FIG. 3A shows the label holder with a marker in the first position therefor.

FIG. 4 is a sectional view along the line IV—IV in FIG. 3.

FIG. 5 is a view intended to illustrate a practical method of using the indicator.

FIG. 1 illustrates a vertically suspended file envelope comprising, a cardboard sheet which is folded at its lower part so as to form two flaps 1 and 2.

At the top there is provided a suspending device formed by rods 3 which extend inside a fold 4 of the flap 1 and which are provided with hooks 5 cooperating with rails (not shown) arranged in a filing cabinet.

Figure 1:
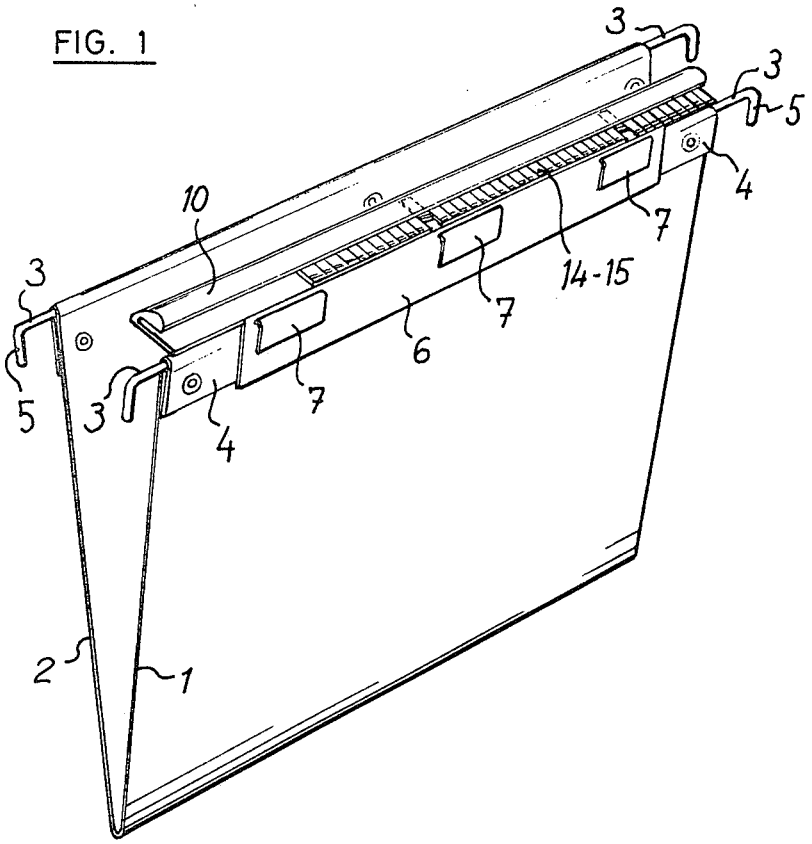
FIG. 1 is a perspective view of the indicator according to the invention.

The indicator of the invention is mounted along the upper edge of the flap 1 and includes an elongated body or plastic slat 6 which is provided with stirrups or supports 7 (FIGS. 1 and 3) serving as clips for mounting the indicator on the file.

Slightly above the upper edge of the flap 1 the body 6 is bent over (bent portion or leg 12) so as to form a label holder 8. A transparent projection 10 is connected to the free edge of the leg 12 as at 9 and extends over a part of the leg to form a window 10 which, in the illustrated example, forms a bead or rim and constitutes, in cooperation with the label holder 8, a recess 11 for receiving elongated labels therein (FIG. 3). Window 10 enables the data located on the labels to be read and when this projection is in the form of a bead this latter may serve as a magnifying lens.

Figure 2:
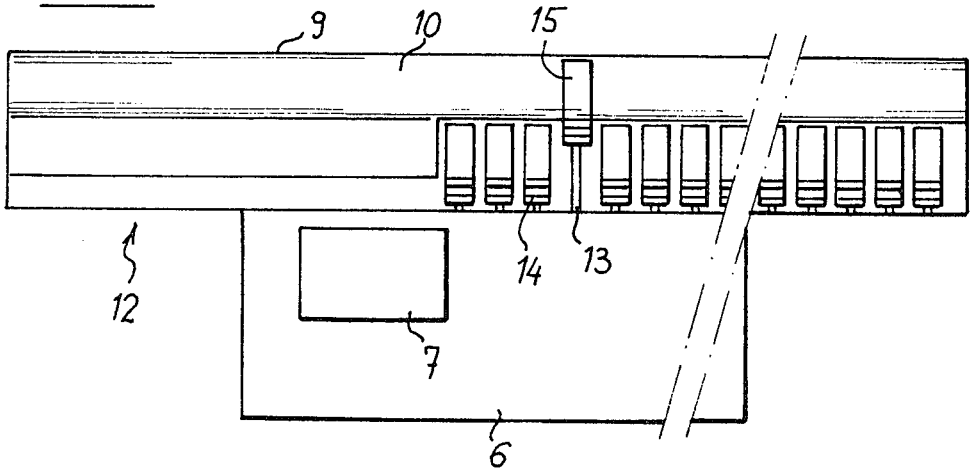
FIG. 2 is a front view of part of the indicator.

In the bent portion or leg 12 there are formed slots 13 (FIG. 2) in which are disposed cursors or markers formed by a block 14 and by a tab 15 FIG. 3. These cursors may occupy a position in which it is fully possible to read the corresponding label portion through the magnifying lens 10 (FIG. 3) and otherpositions (FIG. 3A) in which said label portion is completely or partly covered by the tab 15. Specifically, each marker is movable between the first position of FIG. 3A in which it covers a portion of a label in the label holder and the second position of FIG. 3 in which that portion of the label is completely uncovered.

As shown in FIG. 4, the slots 13 have upwardly converging faces and at this point the wall 14[1] of the block 14 engaging in the slot is of corresponding shape.

A cavity 16 is provided towards the bottom in the part 14[1] of the block 14 so as to allow the cursors to be fitted into the slots 13.

A device of this type is designed to supply the most important data which can be utilized by concerns not having access to a computer.

In a filing cabinet, each vertically suspended file envelope only shows the cursors in their raised position, thus giving the progress situation of the corresponding file.

On opening the file cabinet drawer for instance 50 to 70 files appear with their slats and any file which is not progressing normally is immediately apparent. The situation of each order and its chronology can be seen without touching the file.

More precisely the object to be achieved is as follows:

To be able tc answer immediately and at any time the following question.

Among the hundreds or thousands of order files or the like belonging to a business concern is it certain that:

(a) the progress of the files is normal, in other words that at the various dates scheduled for action, these actions were in fact performed;

(b) in the case in which these dates scheduled for action were not observed, that the necessary operations have in fact been carried out by the departments concerned.

The rule slat or body 6, which may be from 20 to 35 cm according to the form and size of the document, comprises a visible portion in which is inserted a strip of paper bearing data and, in particular, scales.

Merely by way of example it is possible to provide (FIG. 5):

1. a scale "of positions" or spatial movement (reference A).

This latter comprises, for example, 5 to 15 graduations (according to the circumstances and the user's requirements).

Each position represents a stage in the progress of the order:

position a=factory requisition received
position b=cost request sent to supplier
position c=definite order
position d=licence to be presented
position e=licence valid etc. until receipt of goods and, possibly, payment.

2. the second scale is a "time" scale (reference B); it comprises twelve or twenty-four graduations each representing one month. More detailed graduations may be provided according to the user's requirements.

Operation

1. First principle:

The cursors or markers (reference C and $C_1$) with which the indicator is provided are brought into their position during the filing of the document.

Thus no transcription on another document is required.

2. At the time of the movement of the cursor into its new position on the "position" scale, the date of this movement is also posted on the scale.

3. At this time, taking into account the normal period for passing from one position to another, a cursor is moved which has a different color, different shape or a different position. This cursor will indicate the date scheduled for the next progress.

This cursor will be called the "Scheduling" or "Forecast" cursor (reference $C_2$).

The date of the inspection day is indicated by the arrow F in FIG. 5.

The detection of anomalies is effected as follows:

On the day of inspection of files, any "forecast" cursor situated to the left of the date of the day will indicate an irregular file.

These files have to be inspected and the necessary action taken, for example, reminder to supplier, bank reminder, check delivery, remind finance department for payment, documentary letter of credit etc.

Figure 6:
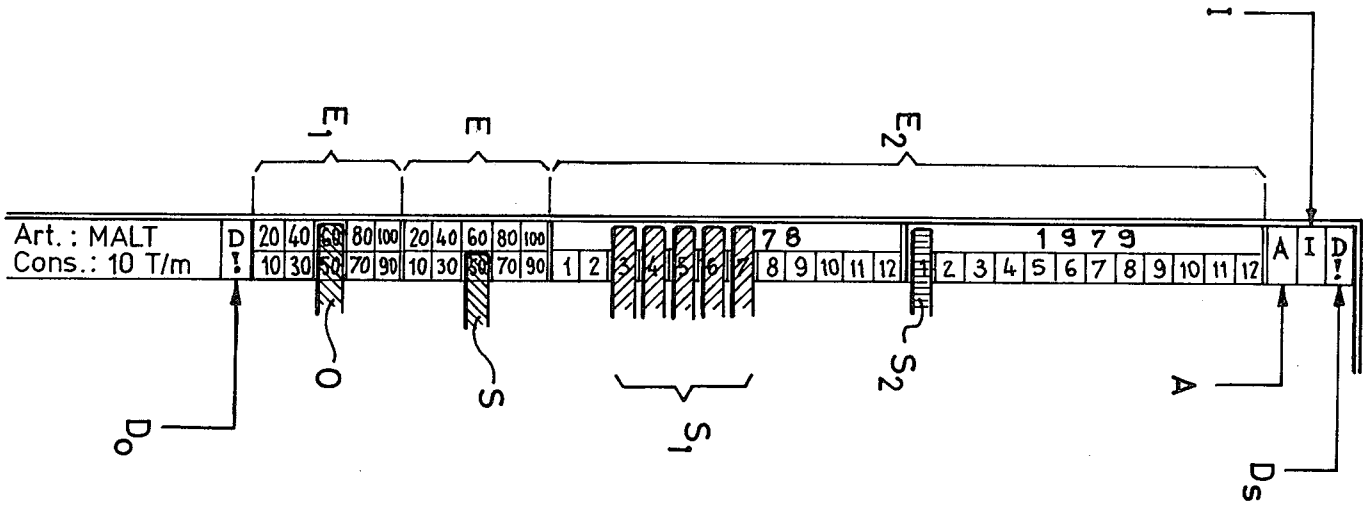
FIG. 6 shows one example of practical use of the indicator according to the invention.
Figure 1:
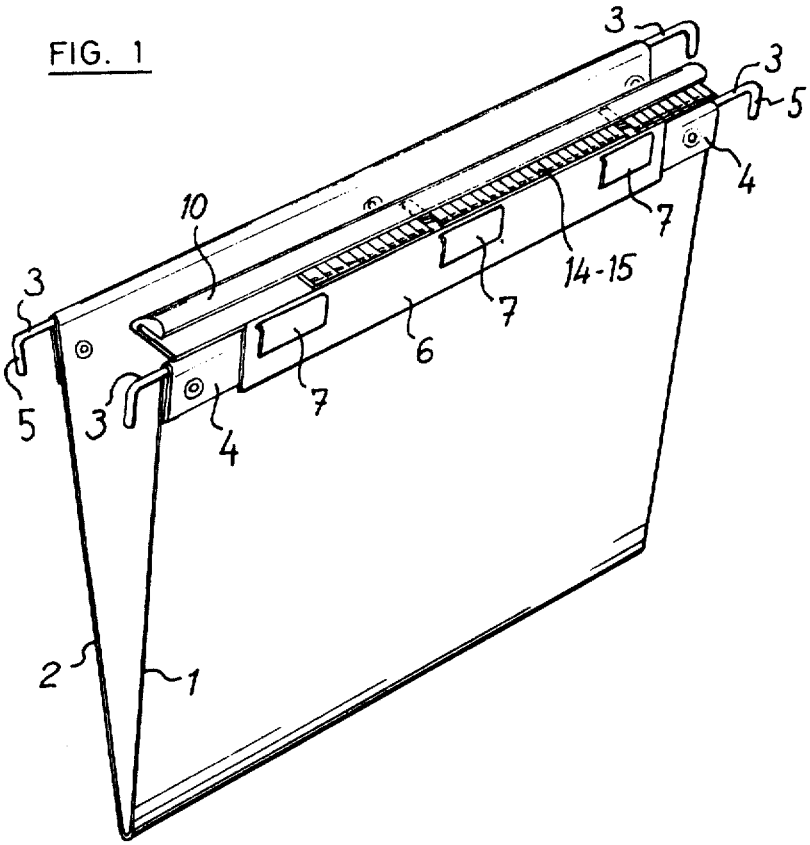
Figure 2:
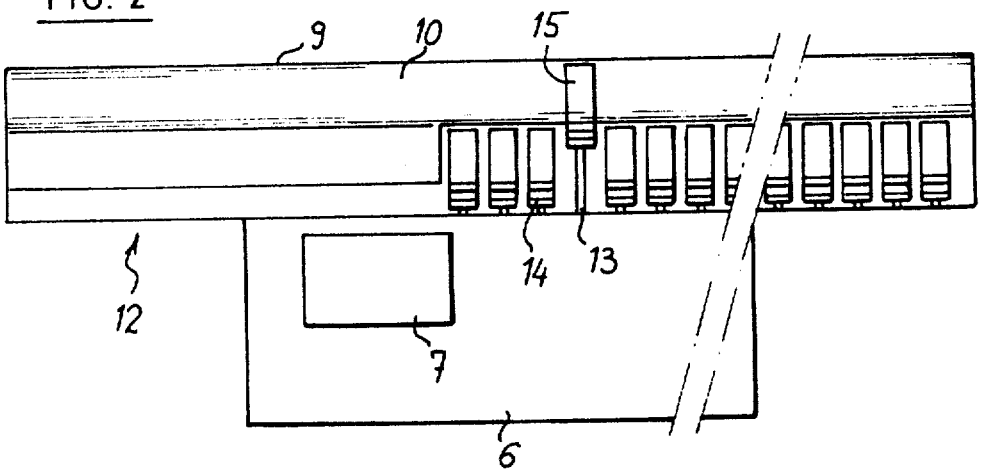
Figure 6:
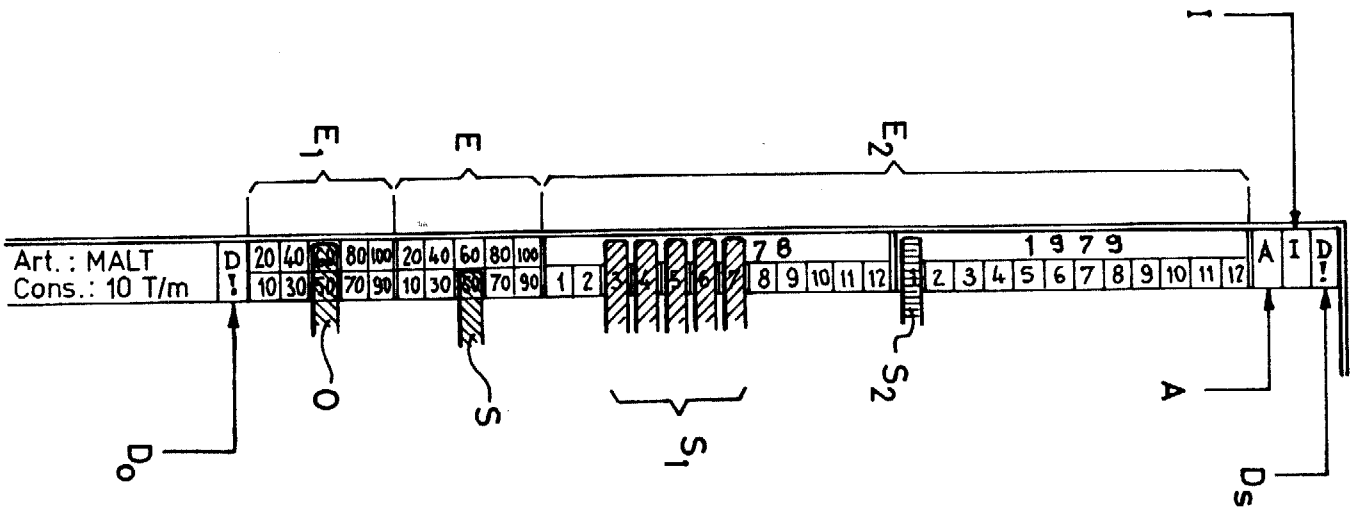

An example of practical use will be given hereafter with reference to FIG. 6 concerning a rule slat relating to the "Stock management" or "Stock Control⇄ in a brewery.

Article: MALT
Rate of consumption 10 T/month
Scale E: Quantity in stock
Scale $E_1$ : ordered quantity
Scale $E_2$ : calendar Situation at March 1, 1978 quantity of malt in stock: 50 Tuns; the stock cursor S is placed on 50 for a forecasted consumption on 10 tuns/month there is a security of 5 months. The five cursors $S_1$ corresponding to the period of March 1978 to July 1978 are displaced so as to occupy the positions shown on FIG. 6 and to indicate the period corresponding to the actual stock;

quantity of ordered malt: 60 tuns; the order cursor O in scale $E_1$ is brought on 60;

taking into account the ordered quantity of security of stock extends until end of January 1979.

A cursor $S_2$ of special color is placed on January so as to indicate the duration of security of stock as soon as the order is received.

In consequence it is possible at every moment to obtain information by a single glance on the stock situation.

Complementarily "warning" cursors may be provided.

In case of an anomaly relating to a pending order a cursor $D_o$ "order danger" f.i. of red color is brought into position.

As an increase of consumption may cause the exhausting of the stock, another cursor $D_s$ "stock danger" can be brought into position in order to draw the attention of the operator.

When action has been taken to solve this problem a cursor I "intervention action" is also brought in position. When the situation is again normal the cursors $D_s$ and I are lowered.

In the case of a situation which is going beyond the calendar (e.g. a situation occuring in 1980) a cursor A is brought in position.

Advantages

1. *Systematic checking* of the files and personel entrusted with their administration; quickness; nothing overlooked.

2. *Systematic watch* on the state of progress of files enabling all the files reaching a certain position to be rapidly extracted.

3. The simultaneous positioning of the "position and time" cursors makes possible, during examination of the files, *rapid checking for plausibility* relative to the forecast cursor.

4. *No special equipment* such as index cards or the like, *no transcription* as a source of errors.

The cursors are positioned on the file itself, at the time of filing.

As other utilization (not limited):
Personnel management and control;
(Absenteism, reprimands, holiday programs etc.)
Control of technical files (erection works, maintenance)
Control of contracts, etc.

What I claim is:

1. An indicator for use with a vertically suspended file envelope, the indicator comprising, an elongated body, means for mounting the body on the file envelope, the said elongated body being provided with a leg extending horizontally with respect to the envelope and having a generally horizontal free edge spaced from said envelope, a transparent projection extending from the free edge of the leg over a part of the leg to define together with the leg a label holder adapted to receive an elongated label therein, a plurality of markers disposed in spaced locations, each marker being mounted on said leg for movement between a first position in which it covers a portion of the label in said label holder and a second position in which said portion of the label is completely uncovered, the status of the file being adapted to be determined from the positioning of the markers relative to the label, said leg having a plurality of spaced parallel slots with upward converging faces and the part of said marker engaging said slot being of corresponding shape.

2. An indicator according to claim 1, in which a cavity is provided in the lower part of said block in order to allow easy fitting of said marker.

3. An indicator according to claim 1 in which each marker comprises a block and a tab, said leg having a plurality of spaced parallel slots in which the markers are slidably mounted, each slot defining a path of travel between said first and second positions.

4. An indicator according to claims 1 in which the transparent projection is in the form of a bead.

5. An indicator according to claims 1 in which the label carried by the label holder comprises a scale of positions, each position representing a stage in the progress of an order and at lest one time scale.

6. An indicator according to claim 5 comprising a scheduling or forecasting cursor in order to detect the anomalies, the relative position of which on said time scale adapted to reveal an anomaly.

* * * * *

UNITED STATES PATENT AND TRADEMARK OFFICE

CERTIFICATE OF CORRECTION

PATENT NO. : 4,255,888

DATED : March 17, 1981

INVENTOR(S) : Jacques J. Bastogne

It is certified that error appears in the above—identified patent and that said Letters Patent is hereby corrected as shown below:

In the (Grant Only) insert the 3 Sheets of Drawings as part of Letters Patent 4,255,888. (See Attachment)

On the Title Page, "6 Claims no Drawings" should read -- 6 Claims 7 Drawing Figures --.

Signed and Sealed this

*Twenty-second* Day of *December 1981*

[SEAL]

*Attest:*

GERALD J. MOSSINGHOFF

*Attesting Officer*

*Commissioner of Patents and Trademarks*

FIG. 3
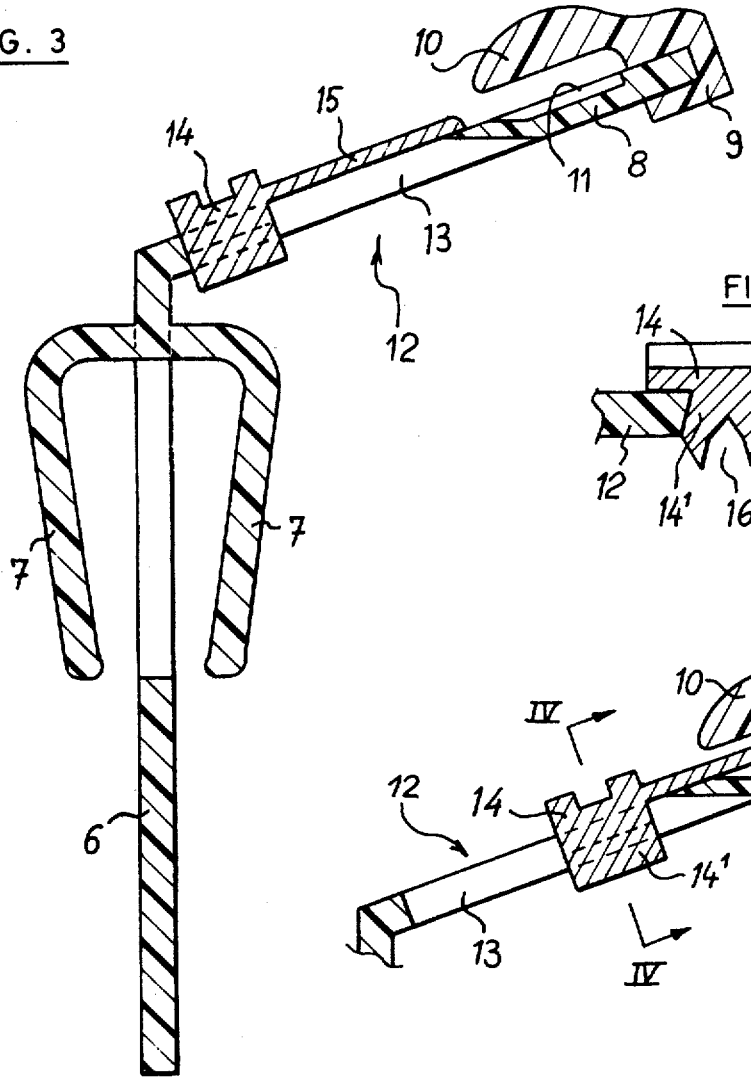
FIG. 4
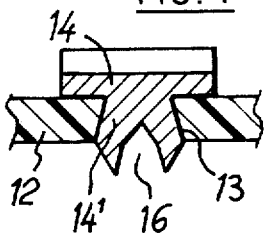
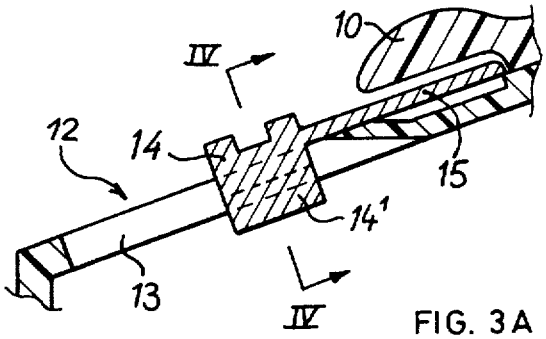
FIG. 3A
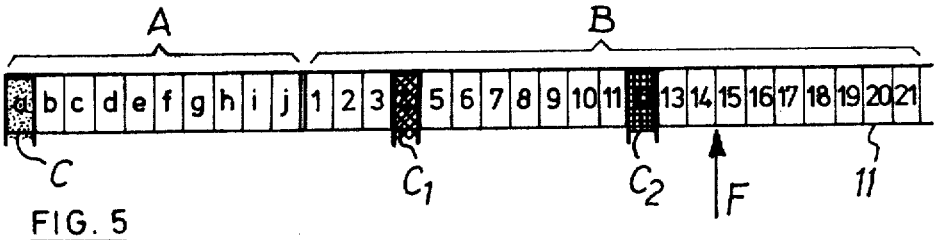
FIG. 5